United States Patent [19]

DeLucchi

[11] Patent Number: 4,621,738

[45] Date of Patent: Nov. 11, 1986

[54] HOLDER FOR WRENCH SOCKETS

[76] Inventor: Christopher J. DeLucchi, 122 Nardo Ave., Solana Beach, Calif. 92075

[21] Appl. No.: 501,877

[22] Filed: Jun. 7, 1983

Related U.S. Application Data

[63] Continuation of Ser. No. 169,946, Jul. 18, 1980, abandoned.

[51] Int. Cl.[4] ..... A47F 7/00

[52] U.S. Cl. ..... 211/70.6; 211/13; 211/89; 206/378; 248/309.1; 294/158; 403/227

[58] Field of Search ..... 211/70.6, 69, 89, 13; 206/378, 376; 224/45 R, 5 A, 5 R, 904; 81/177 G; 411/34; 248/309.1; 403/227; 269/48.1; 294/172, 143, 145, 159, 158

[56] References Cited

U.S. PATENT DOCUMENTS

| | | | |
|---|---|---|---|
| Re. 23,659 | 5/1953 | Steine | 211/69 |
| 1,712,473 | 5/1929 | McWethy | 211/70.6 X |
| 2,102,515 | 12/1937 | Connell | 211/70.6 |
| 2,371,433 | 3/1945 | Davis | 211/70.6 |
| 3,370,696 | 2/1968 | Groe | 211/70.6 |
| 3,405,377 | 10/1968 | Pierce | 211/70.6 |
| 3,726,393 | 4/1973 | Thompson | 211/70.6 X |
| 4,043,453 | 8/1977 | Greenlee | 211/70.6 X |

FOREIGN PATENT DOCUMENTS

| | | | |
|---|---|---|---|
| 598385 | 5/1960 | Canada | 211/70.6 |
| 949040 | 9/1956 | Fed. Rep. of Germany | 206/378 |
| 95761 | 10/1960 | Netherlands | 206/378 |

*Primary Examiner*—Robert W. Gibson, Jr.
*Assistant Examiner*—Blair M. Johnson
*Attorney, Agent, or Firm*—Baker, Maxham & Jester

[57] ABSTRACT

A holder for wrench sockets that includes a support member from which project mounting studs which are configured to receive the nut engaging end of wrench sockets. In one embodiment the socket mounting studs are fabricated integrally with the support member and are arranged thereon in a mandatory sequence of selected order. Another embodiment provides individual mounting studs that may be fitted and secured in a selected order or sequence tailored to the job to be accomplished and includes a locking arrangement integral to the mounting stud which radially expands the stud to grip the installed socket when the stud is turned in one direction.

10 Claims, 5 Drawing Figures

HOLDER FOR WRENCH SOCKETS

This is a continuation of application Ser. No. 169,946 filed July 18, 1980, now abandoned.

BACKGROUND OF THE INVENTION

The invention relates to holders and particularly to a wrench socket holder.

Socket wrench sets with interchangeable sockets that can accommodate nut and bolt heads of varying size and configuration have wide application in mechanical assembly and disassembly tasks. Such tools are useful because of the convenience and versatility inherent in the employment of a single wrench handle and adaptors in conjunction with interchangeable sockets of varying size and shape.

In order to maximize the utility of this tool, however, it is important that availability, sequencial organization, and control of the various socket sizes be established and maintained at a work site. For orderly prosecution of a job, the misplacing or mixing of sockets must be avoided, and necessary sockets kept easily identifiable and available for attachment to the wrench drive. Such organization and control is particularly important in jobs that must be performed quickly and efficiently under adverse conditions due to the nature of the work to be performed and/or environmental conditions involved. For example, installations or repairs to be performed by divers present situations wherein ready access to the needed socket is critical. A diver's time in which to perform the job is limited, and he usually works under conditions of restricted visibility and with encumbered manual dexterity. A diver is further constrained in the number and weight of tools he may carry, and is essentially divorced from ready re-supply. In addition, his movements are subject to interferences which prevent or disrupt the orderly handling of tools and supplies. The water environment in which the diver works is corrosive and tends to destroy the utility of metal storage arrangements.

Various methods for providing for organization, control and display of wrench sockets are available. For usual shop practices, a device which organizes and/or labels the size of the socket is most useful in saving time locating the correct socket. Examples of known socket organizers are reflected in U.S. Pat. Nos. 4,043,453; 3,726,393; 3,405,377 and 1,712,473. However, none of these devices universally prevent sockets from being replaced in storage in the incorrect position as many sockets of different sizes have the same O.D.., height, and/or drive end size.

To aid in the job performance of a worker it is advantageous to provide a universal holder which will provide mandatory control or storable sequence with easily read labels identifying the size of the socket. These features will allow the worker to rapidly locate the correct socket and identify particular sockets which may be missing from their storage position. The holder must be equally effective regardless of drive size, length of the socket, socket O.D., or socket configuration, thus allowing sockets of different types to be mixed.

To aid job performance of a worker under diving or similar adverse conditions, it is therefore advantageous to provide a holder for wrench sockets that is easily transported, and one upon which the sockets are securely held yet easily released with one hand and accessibly arranged in the order of their anticipated use. Such arrangement may include the provision of duplicates in case a socket is lost during the work. It is also important for mechanics working under such constrained conditions to be provided with a wrench socket holder wherein the handling of the sockets when making attachment to the wrench handle is minimized. Further, such a socket holder should be plain in form, corrosion resistant, and easily maintained. The correct socket must be located under conditions of impaired vision or even by feel. The holder for wrench sockets disclosed herein meets these requirements.

SUMMARY AND OBJECTS OF THE INVENTION

The object of the invention is to provide a new and improved wrench socket holder and organizer.

In accordance with a primary aspect of the invention, the wrench socket holder includes socket mounting studs sized and configured for receiving the nut engaging end of a selected socket. Another aspect of the invention includes means for radially expanding the mounting stud for secure engagement with the socket.

BRIEF DESCRIPTION OF THE DRAWINGS

The above and other objects and advantages will become apparent in considering the details of construction and operation of the holder for wrench sockets as it is more fully described in the specification. Reference will be made to the accompanying drawings wherein like numerals refer to like parts throughout and in which.

DESCRIPTION OF THE PREFERRED EMBODIMENTS

Figure 1:
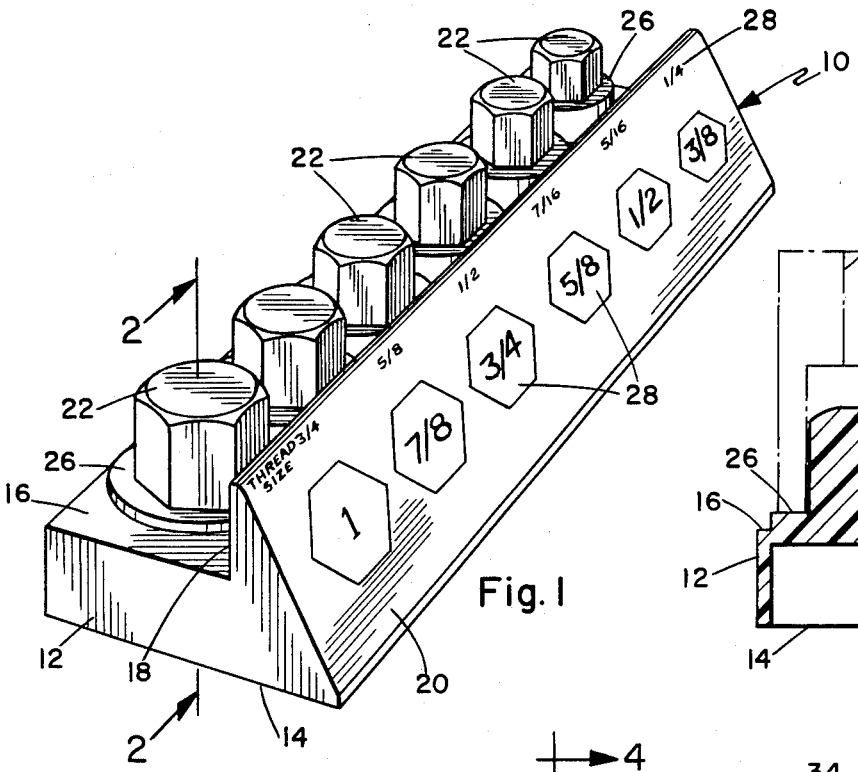
FIG. 1 is a perspective view of one configuration of the socket holder.
Figure 2:
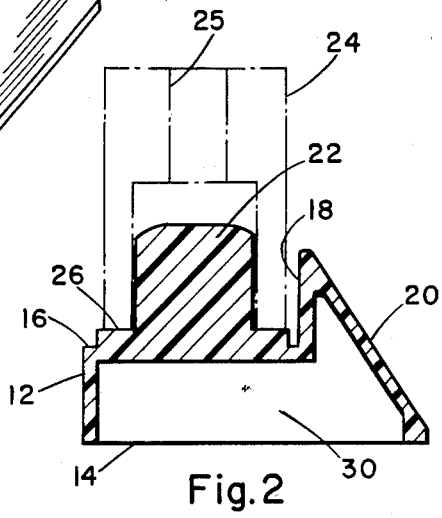
FIG. 2 is a sectional view taken on lines 2—2 of FIG. 1.

The configuration of the first embodiment of the wrench socket holder is shown at 10 in FIG. 1. Support member 12 is a shelf-like structure intended to rest on its flat base 14. Support member 12 has a shelf section 16 and a shelf hood section 18. Hood section 18 is formed by the oblique side 20 of support member 12 and extends above the level of shelf section 16. Wrench socket mounting studs 22 are formed integrally with support member 12 and are arranged along shelf section 16. Mounting studs 22 have a hexagon shape and are sized such that the nut or bolt driving end or recess of wrench sockets may be placed over them. It should be noted that the studs can be shaped to receive sockets having any conventional number of sides. A representative socket 24 fitted over a mounting stud 22 is shown in FIG. 2. Mounting studs 22 are each formed with a base collar 26 against which the open mouth of the installed socket rests. Collar 26 facilitates the removal of an installed socket, and by variations in its width provides a means to control the depth of socket insertion on mounting studs 22. To aid in the use of wrench socket holder 10, socket size indicia 28 are placed on the face of oblique side 20 of support member 12 adjacent to the corresponding mounting studs 22. Indicia 28 may be flat, raised or inset labels, or employ any coded method to indicate socket size or use.

A cross sectional view of support member 12 showing an integral socket mounting stud 22 with a socket 24 installed is shown in FIG. 2. Socket member 12 is formed of a molded plastic and has a hollow interior portion 30 to aid in manufacture and reduce cost.

Figure 3:
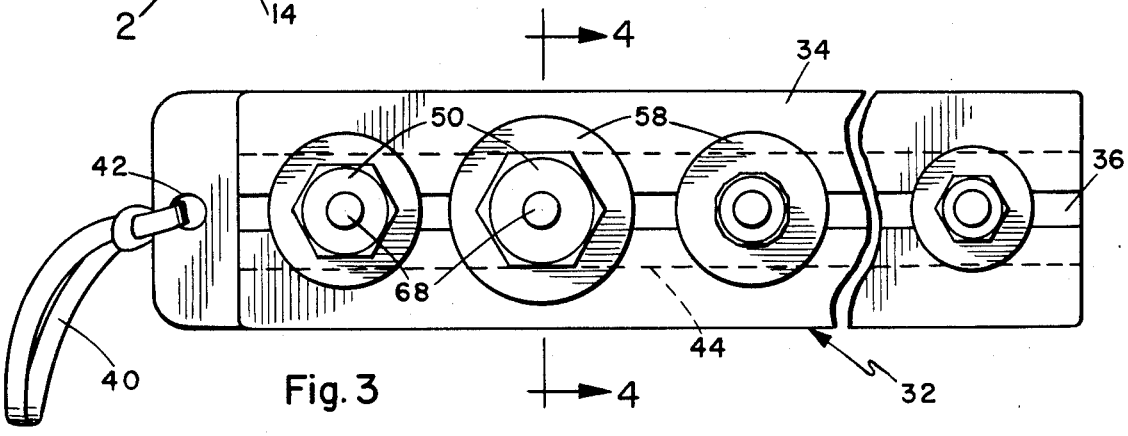
FIG. 3 is a top plan view of an alternative form of the socket holder.
Figure 4:
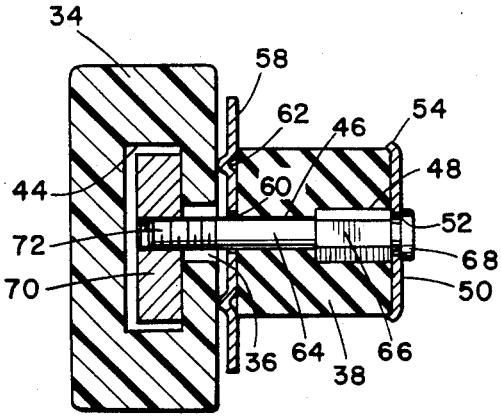
FIG. 4 is an enlarged sectional view taken on line 4—4 of FIG. 3.

The second embodiment of the wrench socket holder is shown generally at 32 in FIG. 3, with further details of construction shown in FIG. 4. Such member 34 is an open ended channel shaped piece with a centered longitudinal slot 36 in one side as shown in FIG. 3. Socket mounting studs 38, to be later described in more detail, are spaced along slot 36 of support member 34. To permit ready transport of support member 34 to the job site, carrying strap 40 is attached to support member 34 by use of aperture 42 located at one end of support member 34. As shown in FIG. 4, support member 34 is formed to enclose channel 44. Slot 36 penetrates support member 34 along one side and permits access therethrough to channel 44.

As previously indicated, in this embodiment socket mounting studs 38 are independent elements mountable along the length of support member 34. This feature is achieved by providing socket mounting studs 38 with an integral locking feature. A representative socket mounting stud 38 and its locking arrangement is depicted in FIG. 4. Mounting stud 38 is formed of resilient material having a hollow central bore 46. Bore 46 has a flat sided (hex or the like) interior section 48 adjacent to the socket receiving end of mounting stud 38, the remainder of the bore 46 being cylindrical in cross section. Compression cap 50 fits over the socket receiving end of mounting stud 38 with a centered aperture 52 in line with the end of bore 46. Compression cap 50 has a shape corresponding to the number of sides of the socket which it fits and has a turned outer rim 54 which fits over the socket receiving end of similarly shaped mounting stud 38 so as to grip the mounting stud. The base of the mounting stud 38 bears against a support plate 58 which also has a central aperture 60 in line with mounting stud bore 46. To aid in mounting and movement of stud 38, support plate 58 is formed with a bearing ring 62 spaced from and concentric with aperture 60 on the side opposite mounting stud 38. As shown in FIG. 4, stud lock bolt 64 passes through mounting stud bore 46 and support plate 58 and has a flat sided section 66 which mates with the correspondingly configured bore section 48 of bore 46, such that bolt 64 will be turned when stud 38 is rotated. Compression cap 50 is secured to lock bolt 64 by a retaining head 68, which can be formed on the lock bolt or could be a screw threaded into the flat sided section 66. The threaded end 72 of lock bolt 64 threads into a nut plate 70 which is slidable along channel 44.

Figure 5:
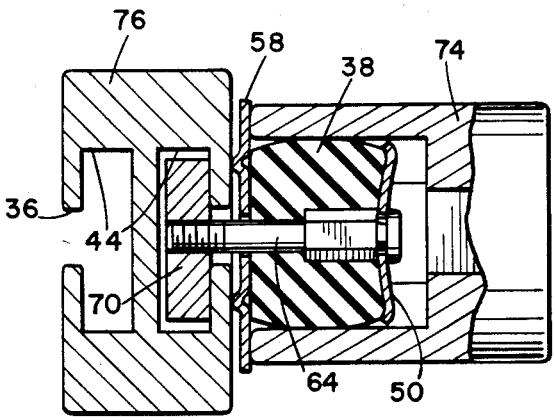
FIG. 5 is a sectional view similar to FIG. 4, but showing a double sided holder with a socket clamped in place.

FIG. 5 further depicts an operational variation of the socket holder support member 34 in the form of a double channel support member 76. Studs can be selectively mounted on either or both sides of the support 76 in any desired pre-determined order.

OPERATION

In the first embodiment, socket holder 10 is manufactured with appropriately sized mounting studs 22 arranged in a preferred order for intended use of the holder. Sockets 24 are placed over the ends of corresponding mounting studs 22. When the sockets 24 are installed, socket drive or handle engaging recess or opening 25 (FIG. 2) is exposed which facilitates attachment of a selected socket to the wrench handle driving head, not shown. Hood section 18 of support member 12 provides protection on one side of holder 12 for the mounting studs 22 with their installed sockets 24 in order to prevent injury to the mounting stud surface or dislodgement of the sockets during handling.

Operation of the second embodiment of the wrench socket holder will be explained with reference to FIGS. 4 and 5. Socket 74 is firmly held on a socket mounting stud 38, which in turn is locked to and projects from support member 34. To exploit the potential of the wrench socket holder, the socket needs of the anticipated job are first considered, and socket mounting studs 38 of the proper size and configuration are selected and arranged on support member 34 according to the job, not necessarily in graduated size order. After attaching lock nut or nut plate 70 to the threaded end of locking bolt 64, the mounting studs 38 are arranged on support member 34 by inserting the shank 65 of locking bolt 64 through slot 36 with lock nut 70 positioned within the channel 44 of support member 34. When appropriately positioned, the socket mounting stud 38 is rotated in the lock direction. Such rotation causes compression cap 50 to be drawn toward support member 34 by means of locking bolt 64 and lock nut 70. With socket 74 installed upon the end of mounting stud 38, further rotation will compress stud 38, causing it to expand radially and tightly grip socket 74. As in the case of the first embodiment, the drive end of socket 74 is exposed to ready attachment to the socket wrench handle drive head. Each socket must be rotated in the unlock direction to relieve compression on the stud 38 and release the socket. The sockets are thus held securely when not in use, so that the holder can be hung from a belt, and unlocked with a one handed operation.

It will be seen from the description herein that I have provided a new and improved device for mandatory sequential control of sockets regardless of socket drive size, type or outer diameter. Numerous changes and modifications may be made in the illustrated embodiments without departing from the scope of the invention as defined in the appended claims.

Having described my invention I claim:

1. A holder for wrench sockets comprising:

a wrench socket support member capable of transport to and use at a job site, a plurality of hexagonal nut shaped wrench socket mounting studs of at least two different specific nut sizes projecting outward from the support member for selectively mounting wrench sockets of the type having a nut engaging recess and a handle engaging recess, each stud being specifically sized to snugly engage a nut engaging recess of only one specifically sized socket, each stud having a different specific size, the holder supporting said sockets in a mandatory selected order of specific nut sizes and with the handle engaging recess of the sockets extending outward for engagement with and connecting to a handle while supported on said studs.

2. A holder for wrench sockets as recited in claim 1 wherein:

the support member is a protected ledge shaped member having a shelf section, and a hood section perpendicular to the shelf section along one edge thereof, the hood section extending to a height above the shelf section, and the socket wrench mounting studs are spaced along the length of the shelf section and project therefrom adjacent to the hood section to afford protection against dislodgement of said sockets installed upon the mounting studs.

3. A holder for wrench sockets comprising:

a wrench socket support member capable of transport to and use at a job site, a plurality of hexagonal nut shaped wrench socket mounting studs of at least two different specific nut sizes projecting outward from the support member, and upon which wrench sockets of the type having a nut engaging recess and a handle engaging recess are storable, each stud being specifically sized to snugly engage a nut engaging recess of only one specifically sized socket, each stud having a different specific size, the holder supporting said sockets in a mandatory selected order of specific nut sizes and with the handle engaging recess of the sockets extending outward for receipt of a handle while supported on said studs, the socket wrench support member is formed as a hollow elongated element having a central slot therein, open at one end and extending a major portion of the length of the support member, and the mounting studs are detachably and slideably mountable in a selected order along the support member slot for projecting outward from the support member.

4. A holder for wrench sockets comprising:

a wrench socket support member capable of transport to and use at a job site formed as a hollow elongated element having a central slot therein, open at one end and extending a major portion of the length of the support member, a plurality of wrench socket mounting studs formed of resilient material, of at least two different sizes, having a nut configuration detachably and slideably mountable in a selected order along the support member slot, and projecting from the support member, locking means for securing the studs to the support member at selected positions along the support member slot, and including means for compressibily expanding the studs radially for gripping said wrench sockets when the studs are rotated in a lock direction.

5. A holder for wrench sockets as recited in claim 4 wherein:

said studs include a hollow central bore of a cross section for receiving and drivingly engaging a threaded shaft.

6. A holder for wrench sockets comprising:

a wrench socket support member capable of transport of and use at a job site, a plurality of wrench socket mounting studs of at least two different sizes having a bore and a nut configuration and projecting from the support member for closely fitting within the nut engaging ends of a plurality of sockets of corresponding sizes for supporting said sockets in a mandatory selected order, the wrench socket support member being formed as a hollow elongated element having a central slot therein open at one end and extending a major portion of the length of said support member, the mounting studs being detachably and slideably mountable in a selected order along the support member slot to project outwardly from the support member, a compression cap disposed over the socket receiving end of the stud and having a central aperture in line with the stud bore, a support plate bearing against the opposite end of the stud, spaced between the support member and the mounting stud, and having a central aperture in line with the stud bore, and a locking bolt defined by said threaded shaft passing through and rotatable within the compression cap and support plate apertures and support member slot and threadable in a locking nut, the locking bolt engaging the stud bore such that the stud is drawn against the stud support member and radially expanded when the stud is turned in the lock direction.

7. A holder for wrench sockets according to claim 1 wherein:

said studs are formed of resilient material, said holder further comprising means for compressibly expanding said studs radially for gripping the nut engaging recess of said wrench sockets.

8. A holder for socket wrenches according to claim 3 wherein:

said studs are formed of a resilient material, said holder further comprising means for compressibly expanding said studs radially for gripping the nut engaging recess of said wrench sockets.

9. A holder for wrench sockets according to claim 1 wherein:

said studs are in a selected order of use.

10. A holder for wrench sockets according to claim 1 wherein:

said studs are in an order of progressively increasing size.

* * * * *